US008628146B2

(12) United States Patent
Baltazar-Lopez et al.

(10) Patent No.: US 8,628,146 B2
(45) Date of Patent: Jan. 14, 2014

(54) METHOD OF AND APPARATUS FOR PLASMA BLASTING

(75) Inventors: Martin E. Baltazar-Lopez, Auburn, AL (US); Steve R. Best, Montgomery, AL (US)

(73) Assignee: Auburn University, Auburn, AL (US)

( * ) Notice: Subject to any disclaimer, the term of this patent is extended or adjusted under 35 U.S.C. 154(b) by 781 days.

(21) Appl. No.: 12/726,038

(22) Filed: Mar. 17, 2010

(65) Prior Publication Data

US 2011/0227395 A1 Sep. 22, 2011

(51) Int. Cl.
*E21C 37/18* (2006.01)

(52) U.S. Cl.
USPC ..... 299/14

(58) Field of Classification Search
USPC ..... 299/14, 16; 175/16; 166/63, 249; 102/313, 327
See application file for complete search history.

(56) References Cited

U.S. PATENT DOCUMENTS

| | | | | |
|---|---|---|---|---|
| 3,679,007 | A | 7/1972 | O'Hare | |
| 4,653,697 | A | 3/1987 | Codina | |
| 4,741,405 | A | 5/1988 | Moeny et al. | |
| 5,106,164 | A | 4/1992 | Kitzinger et al. | |
| 5,573,307 | A | 11/1996 | Wilkinson et al. | |
| 5,773,750 | A | 6/1998 | Jae et al. | |
| 6,283,555 | B1 | 9/2001 | Arai et al. | |
| 6,457,778 | B1 | 10/2002 | Chung et al. | |
| 6,761,416 | B2 * | 7/2004 | Moeny | 299/14 |
| 6,935,702 | B2 * | 8/2005 | Okazaki et al. | 299/14 |
| 2006/0037516 | A1 | 2/2006 | Moeny | |
| 2006/0037779 | A1 | 2/2006 | Moeny et al. | |
| 2006/0038437 | A1 * | 2/2006 | Moeny | 299/14 |

FOREIGN PATENT DOCUMENTS

| | | | |
|---|---|---|---|
| EP | 453076 | A1 * | 10/1991 |
| WO | 2006023998 | A3 | 3/2006 |

OTHER PUBLICATIONS

Yan Li, "Thixotropic properties of aqueous suspension containing cationic starch and aluminum magnesium hydrotalcite-like compound", Journal of Colloid and Interface Science, vol. 313, Sep. 2007, pp. 305-314, www.elsevier.com/locate/jcis.

S. Pronko et al., "Megajoule Pulsed Power Experiments for Plasma Blasting Mining Applications", Ninth IEEE International Pulsed Power Conference, vol. 1, pp. 15-18, Jun. 1993.

(Continued)

*Primary Examiner* — Sunil Singh
(74) *Attorney, Agent, or Firm* — Haverstock & Owens LLP

(57) ABSTRACT

A method, system and apparatus for plasma blasting comprises a solid object having a borehole, a blast probe comprising a high voltage electrode and a ground electrode separated by a dielectric separator, wherein the high voltage electrode and the dielectric separator constitute an adjustable probe tip, and an adjustment unit coupled to the adjustable probe tip, wherein the adjustment unit is configured to selectively extend or retract the adjustable probe tip relative to the ground electrode and a blasting media, wherein at least a portion of the high voltage electrode and the ground electrode are submerged in the blast media. The blasting media comprises a thixotropic or electro-rheological fluid. The adjustable tip permits fine-tuning of the blast. The property of instantaneous high viscosity of thixotropic and electro-rheological fluids is advantageously used to seal the cavity containing the blasting probe thereby increasing the blasting pressure making the whole system more efficient.

56 Claims, 5 Drawing Sheets

(56) References Cited

OTHER PUBLICATIONS

M. Hamelin, "Hard Rock Fragmentation With Pulsed Power", Ninth IEEE International Pulsed Power Conference, vol. 1, pp. 11-14, Jun. 1993.

M. Hamelin, "Components Development for Plasma Blasting Technology", Pulsed Power Conference, Digest of Technical Papers, Tenth IEEE International vol. 2, pp. 1176-1181.

R. Bialecki, "Disintegration of Rock by High Voltage Pulse Discharge", Pulsed Power Conference, Digest of Technical Papers, Eight IEE International, Jun. 16-19, 1991, pp. 838-841.

J. Bernardes, et al.,"Parameter Analysis of a Single Stage Induction Mass Driver", Digest of Technical Papers, 5th IEEE Pulsed Power Conference, Jun. 10-12, 1985, pp. 552-555.

B. H. Bergstrom, "The Electrohydraulic Crusher", Engineering and Mining Journal, vol. 162, pp. 134-140.

* cited by examiner

METHOD OF AND APPARATUS FOR PLASMA BLASTING

STATEMENT REGARDING FEDERALLY SPONSORED RESEARCH

The invention was made in the course of work supported by grant No. 07-060287 from the National Aeronautics and Space Association. The United States government has certain rights in this invention.

FIELD OF THE INVENTION

The present invention relates to the field of improved plasma blasting. More specifically, the present invention relates to the field of a reusable plasma blasting probe with adjustable probe tip for use with thixotropic fluids as an electrolyte media.

BACKGROUND OF THE INVENTION

The field of surface processing for the excavation of hard rock generally comprises conventional drilling and blasting. Specifically, whether for mining or civil construction, the excavation process generally includes mechanical fracturing and crushing as the primary mechanism for pulverizing/excavating rock. Many of these techniques incorporate the use of chemical explosives. However, these techniques, while being able to excavate the hardest rocks at acceptable efficiencies, are unavailable in many situations where the use of such explosives is prohibited due to safety, vibration, and/or pollution concerns.

An alternate method of surface processing for the excavation of hard rock incorporates the use of electrically powered plasma blasting. In this method, a capacitor bank is charged over a relatively long period of time at a low current, and then discharged in a very short pulse at a very high current into a blasting probe comprised of two or more electrodes immersed in a fluid media. The fluid media is in direct contact with the solid substance or sample to be fractured. These plasma blasting methods however, have been historically expensive due to their inefficiency.

SUMMARY OF THE INVENTION

A plasma blasting system for breaking or fracturing solids such as rocks comprises a blasting probe. The blasting probe comprises an adjustment unit, a high voltage electrode, a ground electrode and a dielectric separator. The dielectric separator and the high voltage electrode constitute a probe tip that is coupled to the adjustment unit such that the adjustment unit is able to extend and retract the adjustable tip with respect to the ground electrode. In this manner, the blasting system is able to precisely control the electrode gap and correspondingly the blast power of the system creating a more efficient blasting system. Further, the system comprises a blast media such as a thixotropic fluid that enhances the power of the blasting system relative to the power input into the system by not allowing the blast shock wave cause by the input energy to easily dissipate. Thus, the conversion of input energy to output energy is made more efficient again improving the overall efficiency of the plasma blasting system.

In one aspect the present application relates to a blasting system. The blasting system comprises a solid object having a borehole, a blast probe having a high voltage electrode and a ground electrode, wherein the blast probe is positioned within the borehole and a blast media comprising a thixotropic fluid, wherein at least a portion of the high voltage electrode and the ground electrode are submerged in the thixotropic fluid. In some embodiments, the high voltage electrode and the ground electrode are separated by a dielectric separator wherein the high voltage electrode and the dielectric separator constitute an adjustable probe tip. In some embodiments, the blast probe further comprises an adjustment unit coupled to the adjustable probe tip and configured to extend and retract the blast probe tip relative to the end of the ground electrode. Alternatively, the high voltage electrode and the ground electrode are separated by a dielectric separator wherein the ground electrode and the dielectric separator constitute an adjustable probe tip, and the blast probe further comprises an adjustment unit coupled to the adjustable probe tip and configured to extend and retract the blast probe tip relative to the end of the high voltage electrode. The system further comprises a power supply for providing electrical energy to the system. The system further comprises a switch, an inductor, an electrical storage unit and a voltage protection device each coupled to the blast probe and the power supply via a transmission cable. In some embodiments, the electrical storage unit is a capacitor bank. In some embodiments, the switch is selected from a spark gap, an ignitron, or a solid state switch. The power supply charges the capacitor bank with the electrical energy such that when the switch is activated the capacitor bank transmits the electrical energy to the blast probe. In some embodiments, the high voltage electrode and the ground electrode are separated by a first and a second dielectric separator, wherein the high voltage electrode and the second dielectric separator constitute an adjustable probe tip. The first and second dielectric separators comprise different materials such that the second dielectric is tougher than the first dielectric. The second dielectric surrounds the high voltage electrode in a conic or parabolic formation such that the adjustable probe tip is prevented from bending. In some embodiments, the thixotropic fluid comprises a water suspension of cornstarch. In some embodiments, the thixotropic fluid comprises metal particles. In some embodiments, the thixotropic fluid comprises a combustible liquid.

Another aspect of the present application relates to a blasting system. The blasting system comprises a solid object having a borehole, a blast probe comprising a high voltage electrode and a ground electrode separated by a dielectric separator, wherein the high voltage electrode and the dielectric separator constitute an adjustable probe tip and an adjustment unit coupled to the adjustable probe tip, wherein the adjustment unit is configured to selectively extend or retract the adjustable probe tip relative to the ground electrode and a blasting media, wherein at least a portion of the high voltage electrode and the ground electrode are submerged in the blast media. In some embodiments, the blast media is a thixotropic fluid. In some embodiments, the thixotropic fluid is a water suspension of cornstarch. In some embodiments, the thixotropic fluid comprises metal particles. In some embodiments, the thixotropic fluid comprises a combustible liquid. Alternatively, the blast media is an electro-rheological fluid. Alternatively, the blast media is a solid. In some embodiments, dielectric separator comprises a first dielectric material and a second dielectric material, wherein the second dielectric material surrounds the high voltage electrode in a conic or parabolic formation such that the adjustable probe tip is prevented from bending. The second dielectric material is tougher than the first dielectric material. The system further comprises a power supply for providing electrical energy to the system. The system further comprises a switch, an inductor, an electrical storage unit and a voltage protection device each coupled to the blast probe and the power supply via a transmission cable. In some embodiments, the electrical storage unit is a capacitor bank. In some embodiments, the switch is selected from a spark gap, an ignitron, or a solid state switch. The power supply charges the capacitor bank with the electrical energy such that when the switch is activated the capacitor bank transmits the electrical energy to the blast probe.

In yet another aspect, the present application relates to a blast probe. The blast probe comprises a high voltage electrode and a ground electrode separated by a dielectric separator, wherein the high voltage electrode and the dielectric separator constitute an adjustable probe tip and an adjustment unit coupled to the adjustable probe tip, wherein the adjustment unit is configured to selectively extend or retract the adjustable probe tip relative to the ground electrode. In some embodiments, the dielectric separator comprises a first dielectric material and a second dielectric material, wherein the second dielectric material surrounds the high voltage electrode in a conic or parabolic formation such that the adjustable probe tip is prevented from bending. The second dielectric material is tougher than the first dielectric material.

Another aspect of the present application relates to a method of breaking a solid with a blast probe comprising a high voltage electrode and a ground electrode separated by a dielectric separator, wherein the high voltage electrode and the dielectric separator constitute an adjustable probe tip and an adjustment unit coupled to the adjustable probe tip, wherein the adjustment unit is configured to selectively extend or retract the adjustable probe tip relative to the ground electrode. The method comprises adjusting the position of the adjustable probe tip relative to the ground electrode, inserting the blast probe into a borehole within the solid thereby submerging at least a portion of the ground electrode and high voltage electrode in a blasting media, charging an electrical storage unit coupled to the blast probe with electrical energy and transmitting the electrical energy to blast probe such that the electrical energy causes a plasma stream to form between the high voltage electrode and the ground electrode through the blast media. In some embodiments, the dielectric separator comprises a first dielectric material and a second dielectric material, wherein the second dielectric material surrounds the high voltage electrode in a conic or parabolic formation such that the adjustable probe tip is prevented from bending. The second dielectric material is tougher than the first dielectric material. In some embodiments, the blast media is a thixotropic fluid. In some embodiments, the thixotropic fluid is a water suspension of cornstarch. In some embodiments, the thixotropic fluid comprises metal particles. In some embodiments, the thixotropic fluid comprises a combustible liquid. Alternatively, the blast media is an electro-rheological fluid. Alternatively, the blast media is a solid.

In another aspect, the present application relates to a method of breaking a solid. The method comprises inserting a blast probe comprising a high voltage electrode and a ground electrode into a borehole within the solid thereby submerging at least a portion of the ground electrode and high voltage electrode in a blasting media, charging an electrical storage unit coupled to the blast probe with electrical energy and transmitting the electrical energy to blast probe such that the electrical energy causes a plasma stream to form between the high voltage electrode and the ground electrode through the blast media, wherein the blast media comprises a thixotropic fluid. In some embodiments, the high voltage electrode and the ground electrode are separated by a dielectric separator wherein the high voltage electrode and the dielectric separator constitute an adjustable probe tip. The blast probe further comprises an adjustment unit coupled to the adjustable probe tip and configured to extend or retract the blast probe tip relative to the end of the ground electrode. Alternatively, the high voltage electrode and the ground electrode are separated by a dielectric separator wherein the ground electrode and the dielectric separator constitute an adjustable probe tip, and the blast probe further comprises an adjustment unit coupled to the adjustable probe tip and configured to extend or retract the blast probe tip relative to the end of the high voltage electrode. In some embodiments, the electrical storage unit comprises a capacitor bank. The charging further comprises a power supply coupled to the blast probe and the capacitor bank via a transmission cable, wherein the electrical energy used to charge the capacitor bank is provided by the power supply. The transmitting further comprises a switch coupled to the blast probe and the capacitor bank via the transmission cable, wherein when the transmitting is effectuated by activating the switch such that the capacitor bank is able to transmit the electrical energy to the blast probe. In some embodiments, the switch is selected from a spark gap, an ignitron, or a solid state switch. In some embodiments, the high voltage electrode and the ground electrode are separated by a first and a second dielectric separator, wherein the high voltage electrode and the second dielectric separator constitute an adjustable probe tip. The first and second dielectric separators comprise different materials such that the second dielectric is tougher than the first dielectric. The second dielectric surrounds the high voltage electrode in a conic or parabolic formation such that the adjustable probe tip is prevented from bending. In some embodiments, the thixotropic fluid comprises a water suspension of cornstarch. In some embodiments, the thixotropic fluid comprises metal particles. In some embodiments, the thixotropic fluid comprises a combustible liquid.

DETAILED DESCRIPTION

Figure 1:
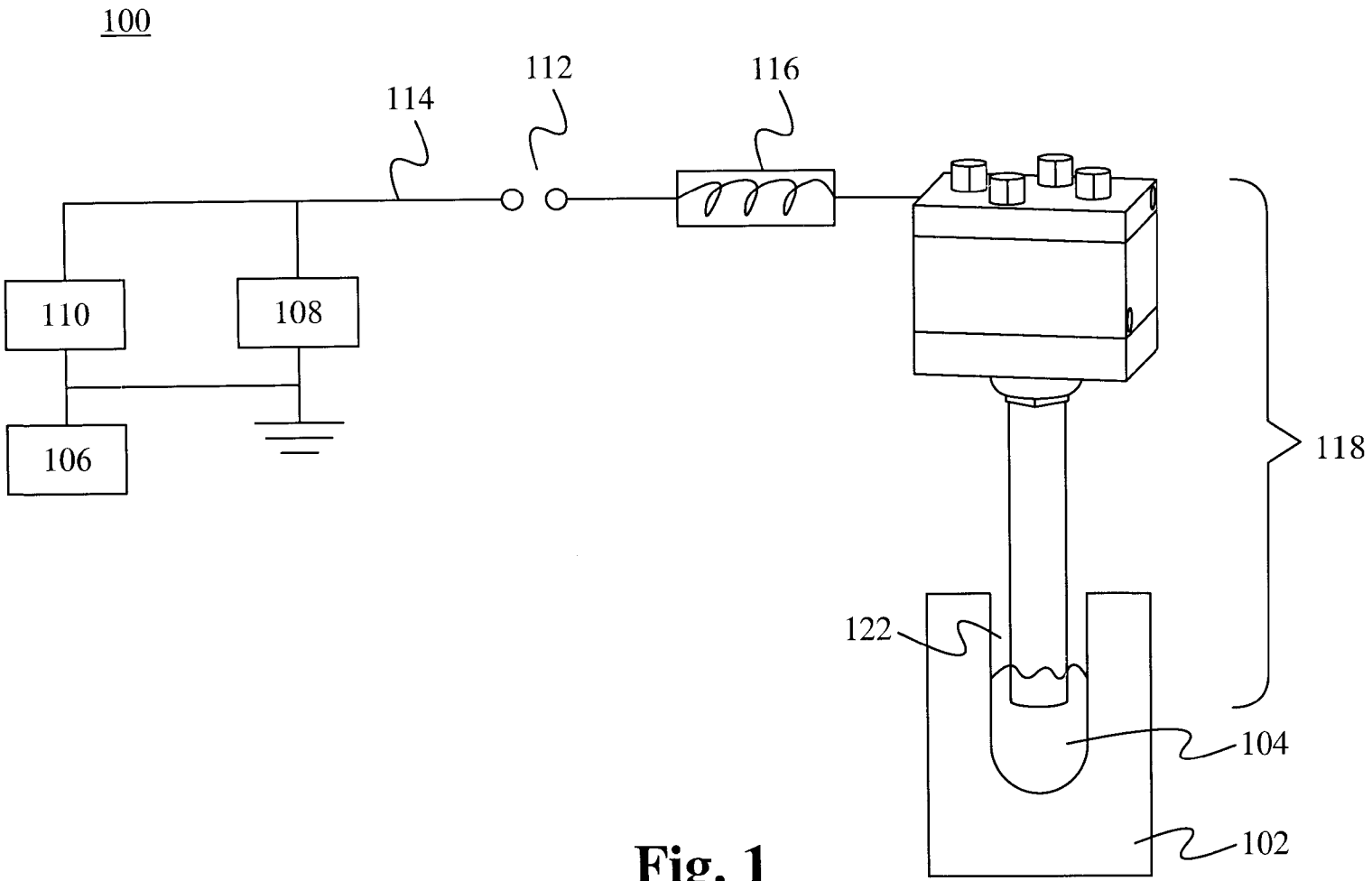
FIG. 1 shows the plasma blasting system in accordance with some embodiments of the Present Application.

FIG. 1 illustrates a plasma blasting system 100 for fracturing a solid 102 in accordance with some embodiments where electrical energy is deposited at a high rate (e.g. a few microseconds), into a blasting media 104 (e.g. an electrolyte), wherein this fast discharge in the blasting media 104 creates plasma confined in a borehole 122 within the solid 102. A pressure wave created by the discharge plasma emanates from the blast region thereby fracturing the solid 102.

In some embodiments, the plasma blasting system 100 comprises a power supply 106, an electrical storage unit 108, a voltage protection device 110, a high voltage switch 112, transmission cable 114, an inductor 116, a blasting probe 118 and a blasting media 104. In some embodiments, the plasma blasting system 100 comprises any number of blasting probes and corresponding blasting media. In some embodiments, the inductor 116 is replaced with the inductance of the transmission cable 114. Alternatively, the inductor 116 is replaced with any suitable inductance means as is well known in the art. The power supply 106 comprises any electrical power supply capable of supplying a sufficient voltage to the electrical storage unit 108. The electrical storage unit 108 comprises a capacitor bank or any other suitable electrical storage means. The voltage protection device 110 comprises a crowbar circuit, Bernades-Merryman topology, or any other voltage-reversal protection means as is well known in the art. The high voltage switch 112 comprises a spark gap, an ignitron, a solid state switch, or any other switch capable of handling high voltages. In some embodiments, the transmission cable 114 comprises a coaxial cable. Alternatively, the transmission cable 114 comprises any transmission cable capable of adequately transmitting the pulsed electrical power.

In some embodiments, the power supply 106 couples to the voltage protection device 110 and the electrical storage unit 108 via the transmission cable 114 such that the power supply 106 is able to supply power to the electrical storage unit 108 through the transmission cable 114 and the voltage protection device 110 is able to prevent voltage reversal from harming the system. In some embodiments, the power supply 106, voltage protection device 110 and electric storage unit 108 also couple to the high voltage switch 112 via the transmission cable 114 such that the switch 112 is able to receive a specified voltage/amperage from the electric storage unit 108. The switch 112 then couples to the inductor 116 which couples to the blasting probe 118 again via the transmission cable 114 such that the switch 112 is able to selectively allow the specified voltage/amperage received from the electric storage unit 108 to be transmitted through the inductor 116 to the blasting probe 118.

Figure 2A:
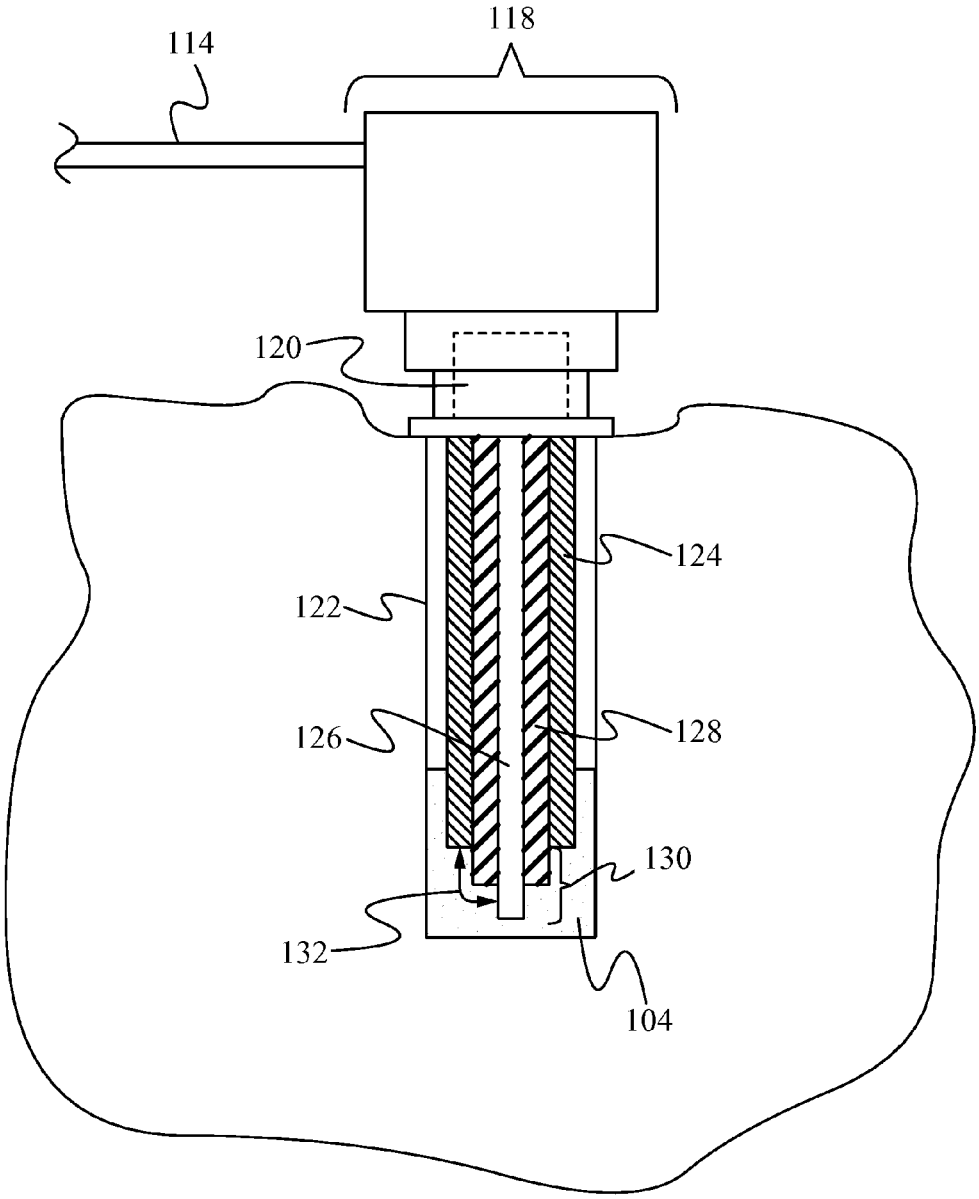
FIG. 2A shows a close up view of the blasting probe in accordance with some embodiments of the Present Application.
Figure 2B:
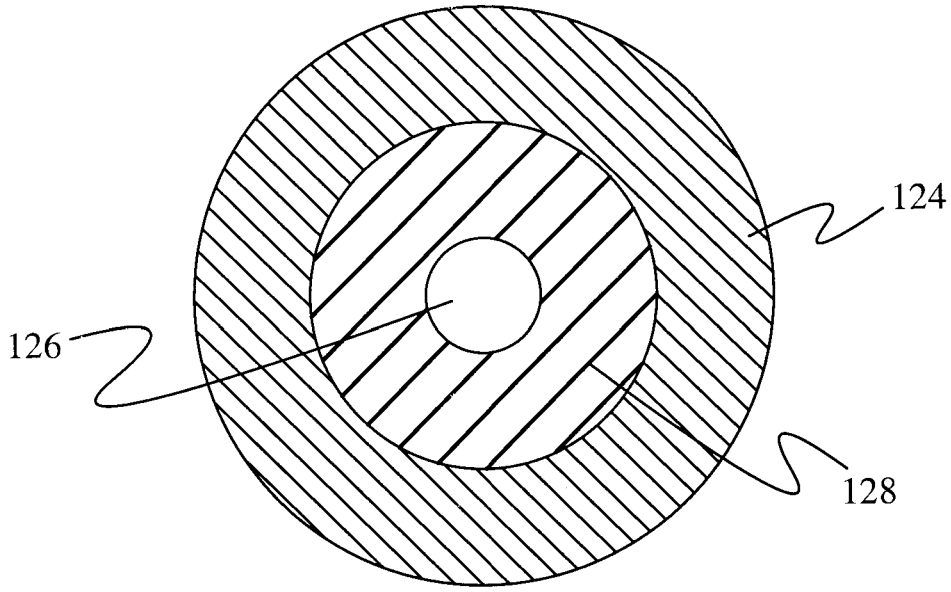
FIG. 2B shows an axial view of the blasting probe in accordance with some embodiments of the Present Application.

As shown in FIG. 2A, the blasting probe 118 comprises an adjustment unit 120, one or more ground electrodes 124, one or more high voltage electrodes 126 and a dielectric separator 128, wherein the end of the high voltage electrode 126 and the dielectric separator 128 constitute an adjustable blasting probe tip 130. The adjustable blasting probe tip 130 is reusable. Specifically, the adjustable blasting probe tip 130 comprises a material and is configured in a geometry such that the force from the blasts will not deform or otherwise harm the tip 130. Alternatively, any number of dielectric separators comprising any number and amount of different dielectric materials are able to be utilized to separate the ground electrode 124 from the high voltage electrode 126. In some embodiments, as shown in FIG. 2B, the high voltage electrode 126 is encircled by the hollow ground electrode 124. Furthermore, in those embodiments the dielectric separator 128 also encircles the high voltage electrode 126 and is used as a buffer between the hollow ground electrode 124 and the high voltage electrode 126 such that the three 124, 126, 128 share an axis and there is no empty space between the high voltage and ground electrodes 124, 126. Alternatively, any other configuration of one or more ground electrodes 124, high voltage electrodes 126 and dielectric separators 128 are able to be used wherein the dielectric separator 128 is positioned between the one or more ground electrodes 124 and the high voltage electrode 126. For example, the configuration shown in FIG. 2B could be switched such that the ground electrode was encircled by the high voltage electrode with the dielectric separator again sandwiched in between, wherein the end of the ground electrode and the dielectric separator would then comprise the adjustable probe tip.

The adjustment unit 120 comprises any suitable probe tip adjustment means as are well known in the art. Further, the adjustment unit 120 couples to the adjustable tip 130 such that the adjustment unit 120 is able to selectively adjust/move the adjustable tip 130 axially away from or towards the end of the ground electrode 124, thereby adjusting the electrode gap 132. In some embodiments, the adjustment unit 120 adjusts/moves the adjustable tip 130 automatically. The term "electrode gap" is defined as the distance between the high voltage and ground electrode 126, 124 through the blasting media 104. Thus, by moving the adjustable tip 130 axially in or out in relation to the end of the ground electrode 124, the adjustment unit 120 is able to adjust the resistance and/or power of the blasting probe 118. Specifically, in an electrical circuit, the power is directly proportional to the resistance. Therefore, if the resistance is increased or decreased, the power is correspondingly varied. As a result, because a change in the distance separating the electrodes 124, 126 in the blasting probe 118 determines the resistance of the blasting probe 118 through the blasting media 104 when the plasma blasting system 100 is fired, this adjustment of the electrode gap 132 is able to be used to vary the electrical power deposited into the solid 102 to be broken or fractured. Accordingly, by allowing more refined control over the electrode gap 132 via the adjustable tip 130, better control over the blasting and breakage yield is able to be obtained.

Figure 3:
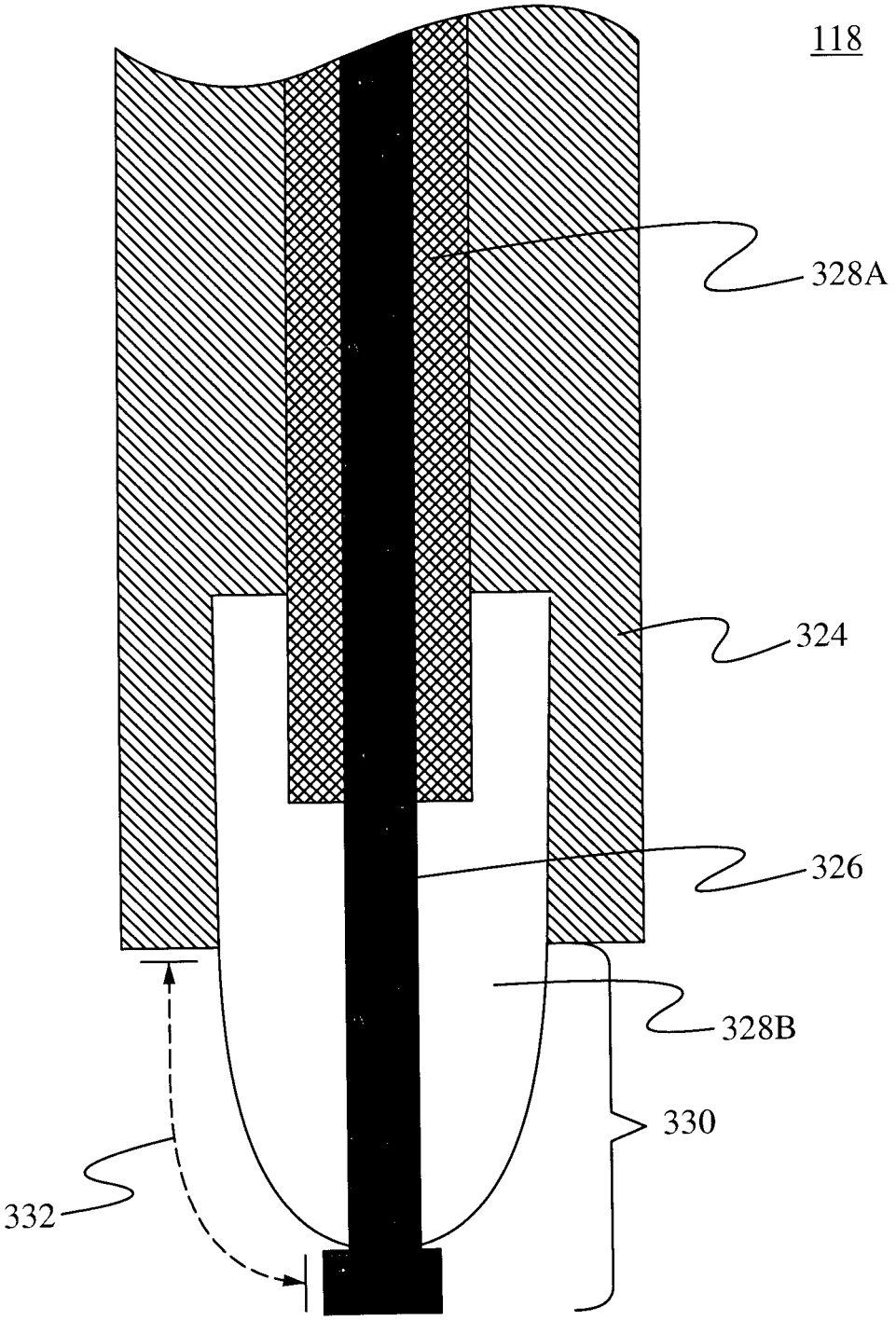
FIG. 3 shows a close up view of the blasting probe comprising two dielectric separators for high energy blasting in accordance with some embodiments of the Present Application.

Another embodiment, as shown in FIG. 3, is substantially similar to the embodiment shown in FIG. 2A except for the differences described herein. As shown in FIG. 3, the blasting probe 118 comprises an adjustment unit (not shown), a ground electrode 324, a high voltage electrode 326, and two different types of dielectric separators, a first dielectric separator 328A and a second dielectric separator 328B. Further, in this embodiment, the adjustable blasting probe tip 330 comprises the end portion of the high voltage electrode 326 and the second dielectric separator 328B. The adjustment unit (not shown) is coupled to the high voltage electrode 326 and the second dielectric separator 328B (via the first dielectric separator 328A), and adjusts/moves the adjustable probe tip 330 axially away from or towards the end of the ground electrode 324, thereby adjusting the electrode gap 332. In some embodiments, the second dielectric separator 328B is a tougher material than the first dielectric separator 328A such that the second dielectric separator 328B better resists structural deformation and is therefore able to better support the adjustable probe tip 330. Similar to the embodiment in FIG. 2A, the first dielectric 328A is encircled by the ground electrode 324 and encircles the high voltage electrode 326 such that all three share a common axis. However, unlike FIG. 2A, towards the end of the high voltage electrode 326, the first dielectric separator 328A is supplanted by a wider second dielectric separator 328B which surrounds the high voltage electrode 326 and forms a conic or parabolic support configuration as illustrated in the FIG. 3. The conic or parabolic support configuration is designed to add further support to the adjustable probe tip 330. Alternatively, any other support configuration could be used to support the adjustable probe tip. Alternatively, the adjustable probe tip 330 is configured to be resistant to deformation. In some embodiments, the second dielectric separator comprises a polycarbonate tip. Alternatively, any other dielectric material is able to be used. In some embodiments, only one dielectric separator is able to be used wherein the single dielectric separator both surrounds the high voltage electrode throughout the blast probe and forms the conic or parabolic support configuration around the adjustable probe tip. In particular, the embodiment shown in FIG. 3 is well suited for higher power blasting, wherein the adjustable blast tip tends to bend and ultimately break. Thus, due to the configuration shown in FIG. 3, the adjustable probe tip 330 is able to be reinforced with the second dielectric material 328B in that the second dielectric material 328B is positioned in a conic or parabolic geometry around the adjustable tip such that the adjustable probe tip 330 is protected from bending due to the blast.

The blasting media 104, as shown in FIGS. 1 and 2, comprises an electrolyte such that the blasting media 104 is able to react with an electrical discharge of the blasting probe 118. Specifically, the electrolyte comprises any combination of a thixotropic fluid, solid or gel, an electro-rheological fluid (ER fluid), solid or gel, or any other non-thixotropic or electro-rheological fluid, solid or gel. In some embodiments, the blasting media 104 is a thixotropic fluid such as a water suspension of cornstarch. Alternatively, the thixotropic fluid comprises cornstarch suspended in a combustible liquid, which are well known in the art, that has a higher energy content than water and thereby more easily reacts with the electrical discharge as described below. In some embodiments, the blasting media 104 is a thixotropic fluid that further comprises metallic powder. This inclusion of metallic powder will propitiate an exothermal reaction to increase the energetic content of the blasting media 104.

As shown in FIGS. 1 and 2, the blasting media 104 is positioned within the borehole 122 of the solid 102, with the adjustable tip 130 and at least a portion of the ground electrode 124 suspended within the blasting media 104 within the solid 102. Correspondingly, the blasting media 104 is also in contact with the inner wall of the borehole 122 of the solid 102. The amount of blasting media 104 to be used is dependent on the size of the solid and the size of the blast desired and its calculation is well known in the art.

The term "thixotropy" describes the reversible isothermal gel/solid/gel transformation induced by shearing and subsequent rest. Thixotropy is a sheer-thinning with time factor/phenomenon, also known as positive thixotropy. Several fluid systems display this property, for example, drilling mud, paint, coatings and many others. Predictably, negative thixotropy, also called antithixotropy, is a rheological phenomenon characterized by a flow-induced increase of the viscosity in time, which is observed in many polymer solutions. Thixotropic fluids are able to be either Newtonian (e.g., have a linear thixotropic response) or non-Newtonian (e.g., have a non-linear thixotropic response). A first property of a non-Newtonian time-dependent thixotropic fluid is that such thixotropic fluids are inert (e.g., non-reactive/non-explosive) such that the fluids are able to be used in space whereas other combustible fluids cannot. A second property of a non-Newtonian time-dependent thixotropic fluid is that it undergoes a decrease in viscosity with time when it is subjected to a constant shearing force. On the other hand, if the shearing force is applied at a very high rate (e.g. in the order of tens of microseconds), the value of the viscosity of the thixotropic fluid tends to increase proportionally to the shearing rate. Therefore, when the thixotropic fluid is subjected to shearing force due to a high pressure (e.g. up to 2.5 GPa) wave within a matter of tens of microseconds, the viscosity of the thixotropic fluid instantly goes very high, making the fluid appear and react more like a solid material. As described in greater detail below, in the present application, this instantaneous high viscosity of a thixotropic fluid is advantageously used to seal the cavity where the plasma blasting probe 118 is inserted; and thus increasing the blasting pressure making the whole system more efficient.

A similar effect is found with semi-conducting fluids having electro-rheological properties. These ER fluids become substantially more viscous (e.g., so as to react like a solid) when subjected to a high electrical field. Indeed, these ER fluids have the feature of being able to change phase between a liquid and a solid-like gel. Specifically, normally, an ER fluid has its particles suspended in a random fashion. However, when an electric field is applied across the ER fluid, the semi-conducting particles are electrically polarized and form chains. As a result, ER fluids' viscosity are able to be manipulated through use of an electric field in a similar manner to thixotropic fluids and shear forces as described above. Again, similar to above, this instantaneous high viscosity of an ER fluid when subjected to a high electrical field is able to be advantageously used to seal the cavity where the plasma blasting probe 118 is inserted as further described below.

Figure 4:
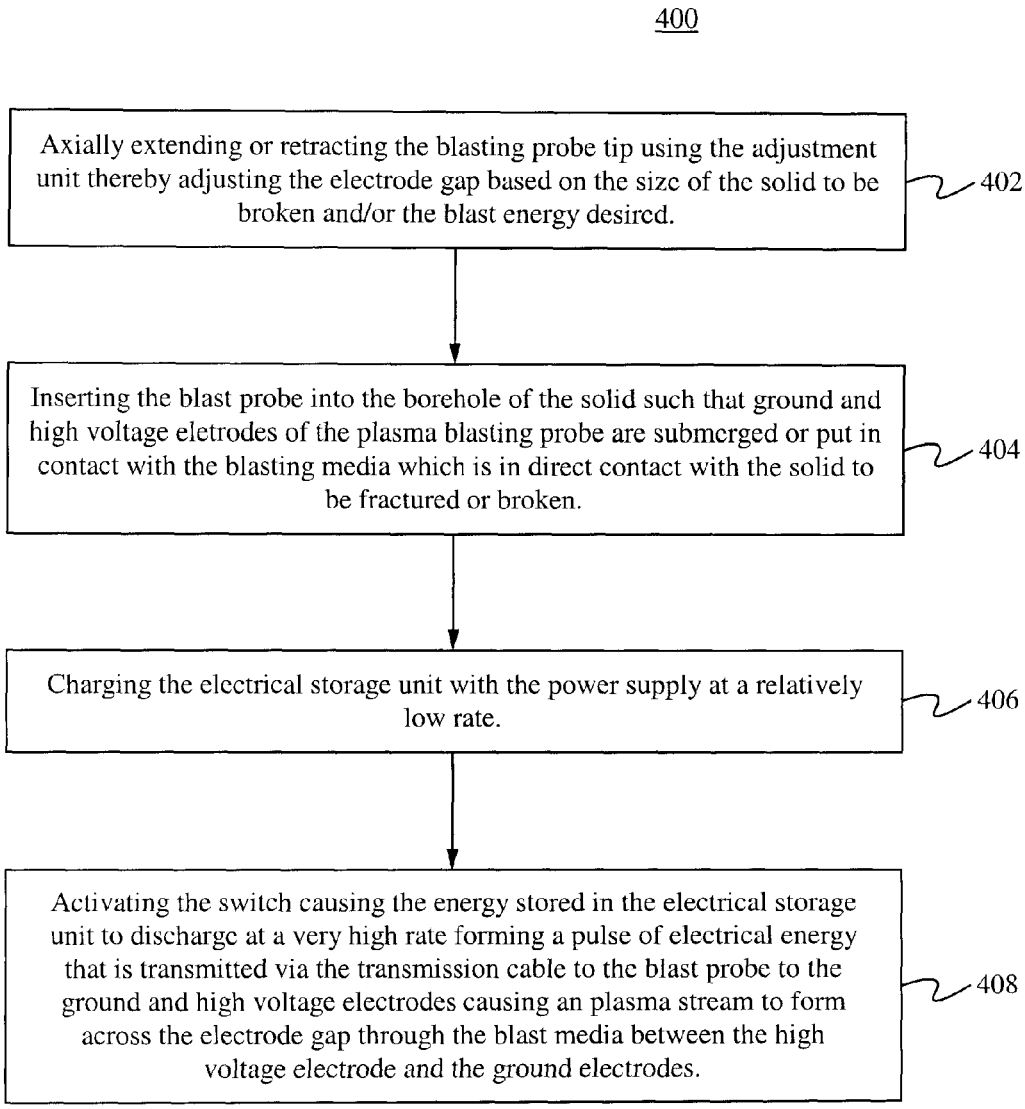
FIG. 4 shows a flow chart illustrating a method of using the plasma blasting system to break or fracture a solid in accordance with some embodiments of the Present Application.

The method and operation 400 of the plasma blasting system 100 will now be discussed in conjunction with a flow chart illustrated in FIG. 4. In operation, as shown in FIGS. 1 and 2, the adjustable tip 130 is axially extended or retracted by the adjustment unit 120 thereby adjusting the electrode gap 132 based on the size of the solid 102 to be broken and/or the blast energy desired at the step 402. The blast probe 118 is then inserted into the borehole 122 of the solid such that at least a portion of the ground and high voltage electrodes 124, 126 of the plasma blasting probe 118 are submerged or put in contact with the blasting media 104 which is in direct contact with the solid 102 to be fractured or broken at the step 404. Alternatively, the electrode gap 132 is able to be adjusted after insertion of the blasting probe 118 into the borehole 122. The electrical storage unit 108 is then charged by the power supply 106 at a relatively low rate (e.g., a few seconds) at the step 406. The switch 112 is then activated causing the energy stored in the electrical storage unit 108 to discharge at a very high rate (e.g. tens of microseconds) forming a pulse of electrical energy (e.g. tens of thousands of Amperes) that is transmitted via the transmission cable 114 to the plasma blasting probe 118 to the ground and high voltage electrodes 124, 126 causing a plasma stream to form across the electrode gap 132 through the blast media 104 between the high voltage electrode 126 and the ground electrode 124 at the step 408.

During the first microseconds of the electrical breakdown, the blasting media 104 is subjected to a sudden increase in temperature (e.g. about 3000 to 4000° C.) due to a plasma channel formed between the electrodes 124, 126, which is confined in the borehole 122 and not able to dissipate. The heat generated vaporizes or reacts with part of the blasting media 104, depending on if the blasting media 104 comprises a liquid or a solid respectively, creating a steep pressure rise confined in the borehole 122. Because the discharge is very brief, a blast wave comprising a layer of compressed water vapor (or other vaporized blasting media 104) is formed in front of the vapor containing most of the energy from the discharge. It is this blast wave that then applies force to the inner walls of the borehole 122 and ultimately breaks or fractures the solid 102. Specifically, when the pressure expressed by the wave front (which is able to reach up to 2.5 GPa), exceeds the tensile strength of the solid 102, fracture is expected. Thus, the blasting ability depends on the tensile strength of the solid 102 where the plasma blasting probe 118 is placed, and on the intensity of the pressure formed. The plasma blasting system 100 described herein is able to provide pressures well above the tensile strengths of common rocks (e.g. granite=10-20 MPa, tuff=1-4 MPa, and concrete=7 MPa). Thus, the major cause of the fracturing or breaking of the solid 102 is the impact of this compressed water vapor wave front which is comparable to one resulting from a chemical explosive (e.g., dynamite).

As the reaction continues, the blast wave begins propagating outward toward regions with lower atmospheric pressure. As the wave propagates, the pressure of the blast wave front falls with increasing distance. This finally leads to cooling of the gasses and a reversal of flow as a low-pressure region is created behind the wave front, resulting in equilibrium.

If the blasting media 104 comprises a thixotropic fluid as discussed above, when the pulsed discharge vaporizes part of the fluid, the other part rheologically reacts by instantaneously increasing in viscosity, due to being subjected to the force of the vaporized wave front, such that outer part of the fluid acts solid like. This now high viscosity thixotropic fluid thereby seals the borehole 122 where the blasting probe 118 is inserted. Simultaneously, when the plasma blasting system 100 is discharged, and cracks or fractures begin to form in the solid 102, this newly high viscosity thixotropic fluid temporarily seals them thereby allowing for a longer time of confinement of the plasma. Thus, the vapors are prevented from escaping before building up a blast wave with sufficient pressure. This increase in pressure makes the blasting process 400 described herein more efficient, resulting in a more dramatic breakage effect on the solid 102 using the same or less energy compared to traditional plasma blasting techniques when water or other non-thixotropic media are used.

Similarly, if the blasting media 104 comprises a ER fluid as discussed above, when the pulsed discharge vaporizes part of the fluid, a strong electrical field is formed instantaneously increasing the non-vaporized fluid in viscosity such that it acts solid like. Similar to above, this now high viscosity ER fluid thereby seals the borehole 122 where the blasting probe 118 is inserted. Simultaneously, when the plasma blasting system 100 is discharged, and cracks or fractures begin to form in the solid 102, this newly high viscosity ER fluid temporarily seals them thereby allowing for a longer time of confinement of the plasma. Thus, again the vapors are prevented from escaping before building up a blast wave with sufficient pressure.

During testing, the blast probe of the blasting system described herein was inserted into solids comprising either concrete or granite with cast or drilled boreholes having one inch diameters. A capacitor bank system was used for the electrical storage unit and was charged at a low current and then discharged at a high current via the high voltage switch 112. Peak power achieved was measured in the megawatts. Pulse rise times were around 10-20 μsec and pulse lengths were on the order of 50-100 μsec. The system was able to produce pressures of up to 2.5 GPa and break concrete and granite blocks with masses of more than 850 kg.

The method of and apparatus for plasma blasting described herein has numerous advantages. Specifically, by adjusting the blasting probe's tip and thereby the electrode gap, the plasma blasting system is able to provide better control over the power deposited into the specimen to be broken. Consequently, the power used is able to be adjusted according to the size and tensile strength of the solid to be broken instead of using the same amount of power regardless of the solid to be broken. Furthermore, the system efficiency is also increased by using a thixotropic or ER blasting media in the plasma blasting system. Specifically, the thixotropic or ER properties of the blasting media maximize the amount of force applied to the solid relative to the energy input into the system by not allowing the energy to easily escape the borehole as described above. Moreover, because the thixotropic or ER blasting media is inert, it is safer than the use of combustible chemicals. As a result, the plasma blasting system is more efficient in terms of energy, safer in terms of its inert qualities, and requires smaller components thereby dramatically decreasing the cost of operation.

Accordingly, for the mining and civil construction industries this will represent more volume of rock breakage per blast at lower cost with better control. For the public works construction around populated areas this represents less vibration, reduced noise and little to no flying rock produced. For the space exploration industry where chemical explosives are a big concern, the use of this inert blasting media is an excellent alternative. Overall, the method of and apparatus for plasma blasting described herein provides an effective reduction in cost per blast and a higher volume breakage yield of a solid substance while being safe, environmentally friendly and providing better control.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A blasting system comprising:

a. a solid object having a borehole;

b. a blast probe having a plurality of electrodes, wherein the blast probe is positioned within the borehole, wherein at least two of the plurality of electrodes are separated by a dielectric separator, and further wherein the dielectric separator and at least one of the at least two of the plurality of electrodes constitute an adjustable probe tip; and c. a blast media comprising a fluid, wherein the fluid is characterized in that, if subjected to a shearing force in the order of tens of microseconds, the viscosity of the fluid increases substantially proportionally to the shearing force;

wherein at least a portion of the plurality of electrodes are submerged in the fluid.

2. The blasting system of claim 1, wherein the blast probe further comprises an adjustment unit coupled to the adjustable probe tip and configured to move the blast probe tip relative to the end of one or more of the plurality of electrodes.

3. The blasting system of claim 1, further comprising a power supply for providing electrical energy to the system.

4. The blasting system of claim 3, further comprising a switch, an inductor, an electrical storage unit and a voltage protection device each coupled to the blast probe and the power supply via a transmission cable.

5. The blasting system of claim 4, wherein the electrical storage unit is a capacitor bank.

6. The blasting system of claim 5, wherein the switch is selected from a spark gap, an ignitron, or a solid state switch.

7. The blasting system of claim 6, wherein the power supply charges the capacitor bank with the electrical energy such that when the switch is activated the capacitor bank transmits the electrical energy to the blast probe.

8. The blasting system of claim 1, wherein the fluid comprises a water suspension of cornstarch.

9. The blasting system of claim 1, wherein the fluid comprises metal particles.

10. The blasting system of claim 1, wherein the fluid comprises a combustible liquid.

11. A blasting system comprising:

a. a solid object having a borehole;

b. a blast probe having a plurality of electrodes, wherein the blast probe is positioned within the borehole, wherein at least two of the plurality of electrodes are separated by a first dielectric separator and a second dielectric separator, wherein at least one of the at least two of the plurality of electrodes and the second dielectric separator constitute an adjustable probe tip; and c. a blast media comprising a fluid, wherein the fluid is characterized in that, if subjected to a shearing force in the order of tens of microseconds, the viscosity of the fluid increases substantially proportionally to the shearing force;

wherein at least a portion of the plurality of electrodes are submerged in the fluid.

12. The blasting system of claim 11, wherein the first and second dielectric separators comprise different materials such that the second dielectric is tougher than the first dielectric.

13. The blasting system of claim 12, wherein the second dielectric surrounds the at least one of the at least two of the plurality of electrodes in a conic or parabolic formation such that the adjustable probe tip is prevented from bending.

14. A blasting system comprising:

a. a solid object having a borehole;

b. a blast probe comprising:

i. a plurality of electrodes separated by a dielectric separator, wherein the dielectric separator and at least one of the plurality of electrodes constitute an adjustable probe tip; and ii. an adjustment unit coupled with the adjustable probe tip, wherein the adjustment unit is configured to selectively move the adjustable probe tip relative to one or more of the plurality of electrodes in an axial direction; and c. a blasting media, wherein at least a portion of the plurality of electrodes are submerged in the blast media.

15. The blasting system of claim 14, wherein the blast media is a fluid characterized in that, if subjected to a shearing force in the order of tens of microseconds, the viscosity of the fluid increases substantially proportionally to the shearing force.

16. The blasting system of claim 15, wherein the fluid is a water suspension of cornstarch.

17. The blasting system of claim 15, wherein the fluid comprises metal particles.

18. The blasting system of claim 15, wherein the fluid comprises a combustible liquid.

19. The blasting system of claim 14, wherein the blast media is an electro-rheological fluid characterized in that, if subjected to an electrical field, the viscosity of the electro-rheological fluid increases substantially proportionately to the strength of the electrical field.

20. The blasting system of claim 14, wherein the blast media is a solid.

21. The blasting system of claim 14, wherein the dielectric separator comprises a first dielectric material and a second dielectric material, wherein the second dielectric material surrounds the at least one of the plurality of electrodes in a conic or parabolic formation such that the adjustable probe tip is prevented from bending.

22. The blasting system of claim 21, wherein the second dielectric material is tougher than the first dielectric material.

23. The blasting system of claim 14, further comprising a power supply for providing electrical energy to the system.

24. The blasting system of claim 23, further comprising a switch, an inductor, an electrical storage unit and a voltage protection device each coupled to the blast probe and the power supply via a transmission cable.

25. The blasting system of claim 24, wherein the electrical storage unit is a capacitor bank.

26. The blasting system of claim 25, wherein the switch is selected from a spark gap, an ignitron, or a solid state switch.

27. The blasting system of claim 26, wherein the power supply charges the capacitor bank with the electrical energy such that when the switch is activated the capacitor bank transmits the electrical energy to the blast probe.

28. The blasting system of claim 14, wherein the position of the dielectric separator defines the shortest distance between exposed portions of the at least one of the plurality of electrodes and exposed portions of the one or more of the plurality of electrodes through the blasting media.

29. A blast probe comprising:

a. a plurality of electrodes separated by a dielectric separator, wherein the dielectric separator and at least one of the plurality of electrodes constitute an adjustable probe tip; and b. an adjustment unit coupled with the adjustable probe tip, wherein the adjustment unit is configured to selectively move the adjustable probe tip relative to one or more of the plurality of electrodes in an axial direction.

30. The blast probe of claim 29, wherein the dielectric separator comprises a first dielectric material and a second dielectric material, wherein the second dielectric material surrounds the at least one of the plurality of electrodes in a conic or parabolic formation such that the adjustable probe tip is prevented from bending.

31. The blast probe of claim 30, wherein the second dielectric material is tougher than the first dielectric material.

32. The blast probe of claim 29, wherein the position of the dielectric separator defines the shortest distance between exposed portions of the at least one of the plurality of electrodes and exposed portions of the one or more of the plurality of electrodes through the blasting media.

33. A method of breaking a solid with a blast probe comprising a plurality of electrodes separated by a dielectric separator, wherein the dielectric separator and at least one of the plurality of electrodes constitute an adjustable probe tip, wherein the adjustment unit is configured to selectively move the adjustable probe tip relative to one or more of the plurality of electrodes in an axial direction, the method comprising:

a. adjusting the position of the adjustable probe tip relative to the one or more of the plurality of electrodes;

b. inserting the blast probe into a borehole within the solid thereby submerging at least a portion of the plurality of electrodes in a blasting media;

c. charging an electrical storage unit coupled to the blast probe with electrical energy; and d. transmitting the electrical energy to blast probe such that the electrical energy causes a plasma stream to form between the plurality of electrodes through the blast media.

34. The method of claim 33, wherein the dielectric separator comprises a first dielectric material and a second dielectric material, wherein the second dielectric material surrounds the at least one of the plurality of electrodes in a conic or parabolic formation such that the adjustable probe tip is prevented from bending.

35. The method of claim 34, wherein the second dielectric material is tougher than the first dielectric material.

36. The method of claim 33, wherein the blast media is a fluid characterized in that, if subjected to a shearing force in the order of tens of microseconds, the viscosity of the fluid increases substantially proportionally to the shearing force.

37. The method of claim 36, wherein the fluid is a water suspension of cornstarch.

38. The method of claim 36, wherein the fluid comprises metal particles.

39. The method of claim 36, wherein the fluid comprises a combustible liquid.

40. The method of claim 33, wherein the blast media is an electro-rheological fluid characterized in that, if subjected to an electrical field, the viscosity of the electro-rheological fluid increases substantially proportionately to the strength of the electrical field.

41. The method of claim 33, wherein the blast media is a solid.

42. The method of claim 33, wherein the position of the dielectric separator defines the shortest distance between exposed portions of the at least one of the plurality of electrodes and exposed portions of the one or more of the plurality of electrodes through the blasting media.

43. A method of breaking a solid comprising:

a. inserting a blast probe comprising a plurality of electrodes into a borehole within the solid thereby submerging at least a portion of the plurality of electrodes in a blasting media, wherein at least two of the plurality of electrodes are separated by a dielectric separator, and further wherein at least one of the at least two of the plurality of electrodes and the dielectric separator constitute an adjustable probe tip;

b. charging an electrical storage unit coupled to the blast probe with electrical energy; and c. transmitting the electrical energy to blast probe such that the electrical energy causes a plasma stream to form between the plurality of electrodes through the blast media;

wherein the blast media comprises a fluid characterized in that, if subjected to a shearing force in the order of tens of microseconds, the viscosity of the fluid increases substantially proportionally to the shearing force.

44. The method of claim 43, wherein the blast probe further comprises an adjustment unit coupled to the adjustable probe tip and configured to move the blast probe tip relative to one or more of the plurality of electrodes.

45. The method of claim 43, wherein the electrical storage unit comprises a capacitor bank.

46. The method of claim 45, wherein the charging further comprises a power supply coupled to the blast probe and the capacitor bank via a transmission cable, wherein the electrical energy used to charge the capacitor bank is provided by the power supply.

47. The method of claim 46, wherein the transmitting further comprises a switch coupled to the blast probe and the capacitor bank via the transmission cable, wherein when the transmitting is effectuated by activating the switch such that the capacitor bank is able to transmit the electrical energy to the blast probe.

48. The method of claim 47, wherein the switch is selected from a spark gap, an ignitron, or a solid state switch.

49. The method of claim 43, wherein the fluid comprises a water suspension of cornstarch.

50. The method of claim 43, wherein the fluid comprises metal particles.

51. The method of claim 43 wherein the fluid comprises a combustible liquid.

52. A method of breaking a solid comprising:

a. inserting a blast probe comprising a plurality of electrodes into a borehole within the solid thereby submerging at least a portion of the plurality of electrodes in a blasting media, wherein at least two of the plurality of electrodes are separated by a first dielectric separator and a second dielectric separator, wherein at least one of the at least two of the plurality of electrodes and the second dielectric separator constitute an adjustable probe tip;

b. charging an electrical storage unit coupled to the blast probe with electrical energy; and c. transmitting the electrical energy to blast probe such that the electrical energy causes a plasma stream to form between the plurality of electrodes through the blast media;

wherein the blast media comprises a fluid characterized in that, if subjected to a shearing force in the order of tens of microseconds, the viscosity of the fluid increases substantially proportionally to the shearing force.

53. The method of claim 52, wherein the first and second dielectric separators comprise different materials such that the second dielectric is tougher than the first dielectric.

54. The method of claim 53, wherein the second dielectric surrounds the at least one of the plurality of electrodes in a conic or parabolic formation such that the adjustable probe tip is prevented from bending.

55. A blasting system comprising:

a. a solid object having a borehole;

b. a blast probe having a plurality of electrodes, wherein the blast probe is positioned within the borehole, wherein at least two of the plurality of electrodes are separated by a dielectric separator, and further wherein the dielectric separator and at least one of the at least two of the plurality of electrodes constitute an adjustable probe tip; and c. a blast media comprising a fluid;

wherein at least a portion of the plurality of electrodes are submerged in the fluid.

56. A method of breaking a solid comprising:

a. inserting a blast probe comprising a plurality of electrodes into a borehole within the solid thereby submerging at least a portion of the plurality of electrodes in a blasting media, wherein at least two of the plurality of electrodes are separated by a dielectric separator, and further wherein the dielectric separator and at least one of the at least two of the plurality of electrodes constitute an adjustable probe tip;

b. charging an electrical storage unit coupled to the blast probe with electrical energy; and c. transmitting the electrical energy to blast probe such that the electrical energy causes a plasma stream to form between at least two of the plurality of electrodes through the blast media;

wherein the blast media comprises a fluid.

* * * * *